US006555972B1

(12) United States Patent
Lestician

(10) Patent No.: US 6,555,972 B1
(45) Date of Patent: Apr. 29, 2003

(54) HIGH FREQUENCY, HIGH EFFICIENCY ELECTRONIC LIGHTING SYSTEM WITH METAL HALIDE LAMP

(75) Inventor: Guy J. Lestician, Lower Smithfield Township, Monroe County, PA (US)

(73) Assignee: LightTech, Group, Inc., Jamaica, NY (US)

( * ) Notice: Subject to any disclaimer, the term of this patent is extended or adjusted under 35 U.S.C. 154(b) by 71 days.

(21) Appl. No.: 09/695,442

(22) Filed: Oct. 24, 2000

Related U.S. Application Data

(63) Continuation-in-part of application No. 09/592,606, filed on Jun. 13, 2000.

(51) Int. Cl.[7] ..... H05B 37/02

(52) U.S. Cl. ..... 315/224; 315/246; 315/247; 315/291; 315/307; 307/270

(58) Field of Search ..... 315/224, 246, 315/248, 291, 307; 313/5; 307/270

(56) References Cited

U.S. PATENT DOCUMENTS

| | | | | |
|---|---|---|---|---|
| 4,392,087 A | | 7/1983 | Zansky | 315/219 |
| 4,717,863 A | | 1/1988 | Zeilet | 315/307 |
| 4,876,485 A | | 10/1989 | Fox | 315/244 |
| 4,937,470 A | | 6/1990 | Zeiler | 307/270 |
| 5,039,920 A | | 8/1991 | Zohis | 315/291 |
| 5,105,127 A | | 4/1992 | Lavaud et al. | 315/291 |
| 5,287,040 A | | 2/1994 | Lestician | 315/291 |
| 5,323,090 A | | 6/1994 | Lestician | 315/291 |
| 5,363,020 A | * | 11/1994 | Chen et al. | 315/224 |
| 5,900,701 A | | 5/1999 | Guhilot et al. | 315/307 |
| 5,929,563 A | | 7/1999 | Genz | 313/571 |
| 6,107,754 A | * | 8/2000 | Kim | 315/291 |
| 6,114,814 A | * | 9/2000 | Shannon et al. | 315/224 |

* cited by examiner

*Primary Examiner*—Don Wong
*Assistant Examiner*—Jimmy T. Vu
(74) *Attorney, Agent, or Firm*—Kenneth P. Glynn, Esq.

(57) ABSTRACT

The present invention is a high ORequency, high efficiency start and quick restart system including a lamp. It includes hook ups for connecting and applying a power input to circuitry; a switch for switching a lamp on and off, and is connected to control power; auto-ranging voltage control circuitry; and a three stage power factor correction micro-chip controller. The microchip controller is a Bi-CMOS microchip. There is also a feedback current sensor; a power factor correction regulator; bulb status feedback; a bulb voltage controller; a conditioning filter; a half-bridge; a DC output inverter; and, output and connection for, as well as, a metal-halide discharge lamp.

18 Claims, 11 Drawing Sheets

TO Fig. 7b
710
720
730
740
760
750
770
790
780
P2
T4
C4
33 nf
C9A
1 uf
J1
R13A
1K
R13
200 K
C13
1 uf
R14
22.6 K
R16
10 K
D13
83
81
R6
4.32 K
R7
4.32 K
R8
5.76 K
150
R10 30Ω
C26
47 uf
C25
.22 uf
C23
6.8 uf
C24
470 pf
C21A
15 uf
R22
360 K
C22
1.5 uf
R26
5 K
R18
8.06 K
C26A
1.5 nf
R17
4.3 K
C19A
1 uf
C18A
1.5 nf
C4A
.33 nf
C17A
8.2 nf
R15
581 K
C15A
82 nf
C29
100 pf
75
C18
47 uf
D18
D8
D7
Q1
Q4
R25
100Ω
79
D11
R4
62 K
C7
R3 520Ω
D14
C5
C6
D16
T1
73
D3
D4
D1
D2
77

R21 51.1 K
R19 16.2 K
U1
REF
Vcc
PFC_OUT
OUTA
OUTB
PGND
ACNO
RAMP
PWIDET
RX/CX
PVFB
PEAO
PIFB
PIFBO
LFB
LEAO
RSET
RT2
RT/CT
INTRPT
C3
.68 uf
C1
2.2 uf
C2
.012 uf
CH1
CR1
CR2
R1
.65Ω
2 W
D5
D6
R2A
470Ω
E1
ACOT
BLACK
GREEN
WHITE
71

HIGH FREQUENCY, HIGH EFFICIENCY ELECTRONIC LIGHTING SYSTEM WITH METAL HALIDE LAMP

REFERENCE TO RELATED APPLICATIONS

This application is a continuation-in-part of copending U.S. patent application Ser. No. 09/592,606, entitled "High Frequency, High Efficiency Quick Restart Electronic Lighting System", which was filed on Jun. 13, 2000 by the same inventor herein.

BACKGROUND OF THE INVENTION

1. Field of the Invention

The present invention is directed to a system for quick restart of metal halide high pressure discharge lamps. The system is a high frequency, high efficiency system which includes ballast features and utilizes a three stage power factor correction microchip in a unique circuit to achieve a diverse, superior device.

2. Information Disclosure Statement

The following patents represent the state of the art in ballast and lamp lighting systems:

U.S. Pat. No. 5,929,563 to Andreas Genz describes a metal-halide high-pressure discharge lamp with a discharge vessel and two electrodes which has an inside discharge vessel and ionizable filling, which contains yttrium (Y) in addition to inert gas, mercury, halogen, thallium (Tl), hafnium (Hf), whereby hafnium can be replaced wholly or partially by zirconium (Zr), dysprosium (Dy) and/or gadolinium (Gd) as well as, optionally, cesium (Cs). Preferably, the previously conventional quantity of the rare-earth metal is partially replaced by a molar equivalent quantity of yttrium. With this filling system, a relatively small tendency toward devitrification is obtained even with high specific arc powers of more than 120 W per mm of arc length or with high wall loads. Thus, the filling quantity of cesium can be clearly reduced relative to a comparable filling without yttrium, whereby an increase in the light flux and particularly in the brightness can be achieved.

U.S. Pat. No. 5,900,701 to Hansraj Guhilot et al. describes a lighting inverter which provides voltage and current to a gas discharge lamp in general and a metal halide lamp in particular with a novel power factor controller. The power factor controller step down converter having the device stresses of a buck converter, continuous current at its input like a CUK converter, a high power factor, low input current distortion and high efficiency. The inverter consists of two cyclically rotated CUK switching cells connected in a half bridge configuration and operated alternately. The inverter is further optimized by using integrated magnetics and a shared energy transfer capacitor. The AC voltage output from the inverter is regulated by varying its frequency. A ballast filter is coupled to the regulated output of the inverter. The ballast filter is formed by a series circuit of a ballast capacitor and a ballast inductor. The lamp is preferably connected across the inductor to minimize the acoustic arc resonance. The values of the capacitor and the inductor are chosen so as to satisfy the firing requirements of the HID lamps. A plurality of lamps are connected by connecting the multiple lamps with the ballast filters to the secondary of the inverter transformer. Almost unity power factor is maintained at the line input as well as the lamp output.

U.S. Pat. No. 5,323,090 to Guy J. Lestician is directed to an electronic ballast system including one or more gas discharge lamps which have two unconnected single electrodes each. The system is comprised of a housing unit with electronic circuitry and related components and the lamps. The system accepts a.c. power and rectifies it into various low d.c. voltages to power the electronic circuitry, and to one or more high d.c. voltages to supply power for the lamps. Both the low d.c. voltages and the high d.c. voltages can be supplied directly, eliminating the need to rectify a.c. power. The device switches a d.c. voltage such that a high frequency signal is generated. Because of the choice of output transformers matched to the high frequency (about 38 kHz) and the ability to change frequency slightly to achieve proper current, the device can accept various lamp sizes without modification. The ballast can also dim the lamps by increasing the frequency. The device can be remotely controlled. Because no filaments are used, lamp life is greatly extended.

U.S. Pat. No. 5,287,040 to Guy J. Lestician is directed to an electronic ballast device for the control of gas discharge lamps. The device is comprised of a housing unit with electronic circuitry and related components. The device accepts a.c. power and rectifies it into various low d.c. voltages to power the electronic circuitry, and to one or more high d.c. voltages to supply power for the lamps. Both the low d.c. voltages and the high d.c. voltages can be supplied directly, eliminating the need to rectify a.c. power. The device switches a d.c. voltage such that a high frequency signal is generated. Because of the choice of output transformers matched to the high frequency (about 38 kHz) and the ability to change frequency slightly to achieve proper current, the device can accept various lamp sizes without modification. The ballast can also dim the lamps by increasing the frequency. The device can be remotely controlled.

U.S. Pat. No. 5,105,127 to Georges Lavaud et al. describes a dimming device, with a brightness dimming ratio of 1 to 1000, for a fluorescent lamp used for the backlighting of a liquid crystal screen which comprises a periodic signal generator for delivering rectangular pulses with an adjustable duty cycle. The pulses are synchronized with the image synchronizing signal of the liquid crystal screen. An alternating voltage generator provides power to the lamp only during the pulses. The decrease in tube efficiency for very short pulses allows the required dimming intensity to be achieved without image flickering.

U.S. Pat. No. 5,039,920 to Jerome Zonis describes a gas-filled tube which is operated by application of a powered electrical signal which stimulates the tube at or near its maximum efficiency region for lumens/watt output; the signal may generally stimulate the tube at a frequency between about 20 KHz and about 100 KHz with an on-to-off duty cycle of greater than one-to-one. Without limiting the generality of the invention, formation of the disclosed powered electrical signal is performed using an electrical circuit comprising a feedback transformer having primary and secondary coils, a feedback coil, and a bias coil, operatively connected to a feedback transistor and to a plurality of gas-filled tubes connected in parallel.

U.S. Pat. No. 4,937,470 to Kenneth T. Zeiler describes a gate driver circuit which is provided for push-pull power transistors. Inverse square wave signals are provided to each of the driver circuits for activating the power transistors. The combination of an inductor and diodes provides a delay for activating the corresponding power transistor at a positive transition of the control signal, but do not have a significant delay at the negative transition. This provides protection to prevent the power transistors from being activated concurrently while having lower power loss at high drive frequencies. The control terminal for each power transistor is connected to a voltage clamping circuit to prevent the negative transition from exceeding a predetermined limit.

U.S. Pat. No. 4,876,485 to Leslie Z. Fox describes an improved ballast that operates an ionic conduction lamp such as a conventional phosphor coated fluorescent lamp. The ballast comprises an ac/dc converter that converts an a-c power signal to a d-c power signal that drives a transistor tuned-collector oscillator. The oscillator is comprised of a high-frequency wave-shape generator that in combination with a resonant tank circuit produces a high-frequency signal that is equivalent to the resonant ionic frequency of the phosphor. When the lamp is subjected to the high frequency, the phosphor is excited which causes a molecular movement that allows the lamp to fluoresce and emit a fluorescent light. By using this lighting technique, the hot cathode of the lamp, which normally produces a thermionic emission, is used only as a frequency radiator. Therefore, if the cathode were to open, it would have no effect on the operation lamp. Thus, the useful life of the lamp is greatly increased.

U.S. Pat. No. 4,717,863 to Kenneth T. Zeilier describes a ballast circuit which is provided for the start-up and operation of gaseous discharge lamps. A power transformer connected to an inductive/capacitive tank circuit drives the lamps from its secondary windings. An oscillator circuit generates a frequency modulated square wave output signal to vary the frequency of the power supplied to the tank circuit. A photodetector feedback circuit senses the light output of the lamps and regulates the frequency of the oscillator output signal. The feedback circuit also may provide input from a remote sensor or from an external computer controller. The feedback and oscillator circuits produce a high-frequency signal for lamp start-up and a lower, variable frequency signal for operating the lamps over a range of light intensity. The tank circuit is tuned to provide a sinusoidal signal to the lamps at its lowest operating frequency, which provides the greatest power to the lamps. The ballast circuit may provide a momentary low-frequency, high power cycle to heat the lamp electrodes just prior to lamp start-up. Power to the lamps for start-up and dimming is reduced by increasing the frequency to the tank circuit, thereby minimizing erosion of the lamp electrodes caused by high voltage.

U.S. Pat. No. 4,392,087 to Zoltan Zansky describes a low cost high frequency electronic dimming ballast for gas discharge lamps is disclosed which eliminates the need for external primary inductance or choke coils by employing leakage inductance of the transformer. The system is usable with either fluorescent or high intensity discharge lamps and alternate embodiments employ the push-pull or half-bridge inverters. Necessary leakage inductance and tuning capacitance are both located on the secondary of the transformer. Special auxiliary windings or capacitors are used to maintain necessary filament heating voltage during dimming of fluorescent lamps. A clamping circuit or auxiliary tuned circuit may be provided to prevent component damage due to over-voltage and over-current if a lamp is removed during operation of the system.

Notwithstanding the prior art, the present invention is neither taught nor rendered obvious thereby.

SUMMARY OF THE INVENTION

The present invention is a high frequency, high efficiency quick restart system for lighting a particular type of bulb, including the bulb itself, namely, a metal halide high pressure lamp. It includes ballast features and other aspects and has a base or housing unit to support circuitry and related components, e.g. one or more circuit boards or a combination of circuit boards, supports or enclosures. The electronic circuitry and components mounted on the housing unit, includes: means for connecting and applying a power input to the circuitry; switch means for switching a lamp on and off, which switch means control is connected to control power to the circuitry; and auto-ranging voltage control circuitry and components, including an auto line supply filter and a line voltage correction EMI to provide an auto-ranging voltage intake/output capability. There is also a three stage power factor correction microchip controller. This microchip controller is a Bi-CMOS microchip. There is a feedback current sensor; a power factor correction regulator; a bulb status feedback means; a bulb voltage controller; a conditioning filter; a half-bridge; a DC output inverter; and, output means and connection for a lamp. The means for connecting and applying a power input to the circuitry may have connection and adaption for receiving AC current and/or DC current. The three stage power factor correction microchip controller includes power detection means for end-of-lamp-life detection, a current sensing PFC section based on continuous, peak or average current sensing, and a low start up current of less than about 1.0 milliamps. In preferred embodiments, the three stage power factor correction microchip contains a three frequency control sequencer. Some of the features of the power factor correction microchip include power detect for end-of-lamp life detection; low distortion, high efficiency continuous boost, peak or average current sensing PFC section; leading edge and trailing edge synchronization between PFC and ballast; one to one frequency operation between PFC and ballast; programmable start scenario for rapid/instant start lamps; triple frequency controls network for dimming or starting to handle various lamp sizes; programmable restart for lamp out condition to reduce ballast heating; internal over-temperature shutdown; PFC over-voltage comparator to eliminate output runaway due to load removal; and low start up current.

In most preferred embodiments the three stage power factor correction microchip includes corrections for each of the following functions:

(1) inverting input to a PFC error amplifier and OVP comparator input;

(2) PFC error amplifier output and compensation mode;

(3) sense inductor current and peak current sense point of PFC cycle-by-cycle current limit;

(4) output of current sense amplified;

(5) inverting input of lamp error amplifier to sense and regulate lamp arc current;

(6) output lamp current error transconductance amplifier to sense and regulate lamp arc current;

(7) external resistor to set oscillator to $F_{max}$ and $R_x/C_x$ charging current;

(8) oscillator timing component to set start frequency;

(9) oscillator timing components;

(10) input for lamp-out detection and restart;

(11) resistance/capacitance to set timing for preheat and interrupt;

(12) timing set for preheat and for interrupt;

(13) integrated voltage for error amplifier output;

(14) analog ground;

(15) power ground;

(16) ballast MOSFET first drive/output;

(17) ballast MOSFET second drive/output;

(18) power factor MOSFET driver output;

(19) positive supply voltage; and,

(20) buffered output for specific voltage reference, e.g. 7.5 volt reference.

The power factor correction regulator in the present invention system is a power factor correction regulator with one MOSFET switching circuit, or two MOSFET switching circuits, and the DC output inverter is a DC output inverter with two MOSFET switching circuits, or four MOSFET switching circuits.

The lamp is a metal-halide high pressure discharge lamp with a discharge vessel and two electrodes. It contains an ionizable filling, which includes an inert gas, e.g. argon, mercury, a halogen, e.g. either iodine or bromine or a combination thereof, and metals which combine with these halogens to for metal halides, e.g. scandium, sodium, dysprosium, holmium and thulium rare earth metals. Preferably, the metal halides formed are in combination. Two typical combinations of halides used in these lamps are: (1) scandium and sodium iodides, and, (2) dysprosium, holmium and thulium iodides. The present invention contemplates utilization of what are conventionally known as metal halide lamps in combination with the circuitry features described above and in greater detail below.

The system of the present invention not only illuminates these lamps well, but also provides for heretofore unachieved rapid restart capabilities.

In some preferred embodiments, the electronic circuitry and components switch means further includes dimmer circuitry and components.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
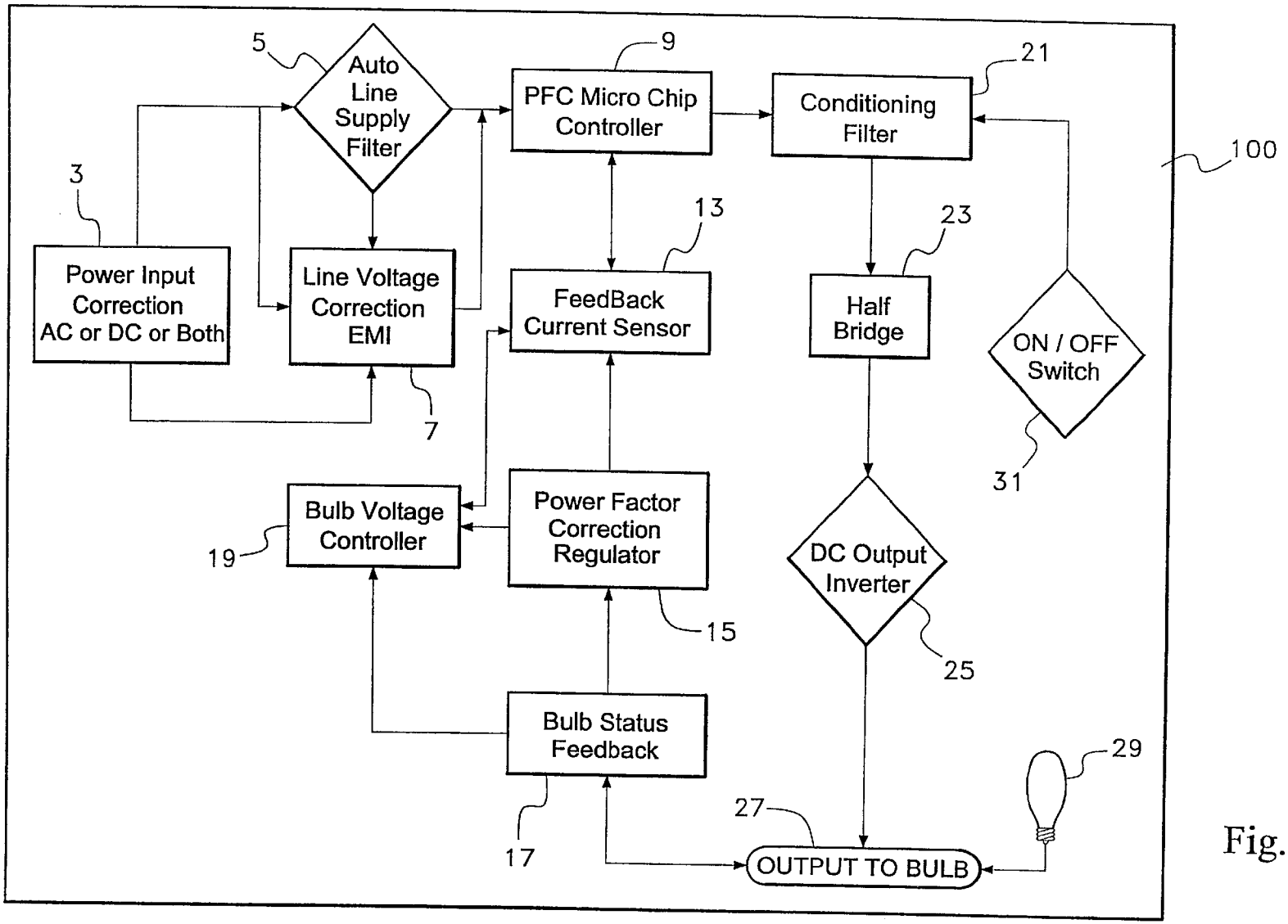
FIG. 1 shows a schematic diagram of the functional aspects of one preferred embodiment of the present invention high frequency, high efficiency quick restart electronic lighting system.

FIG. 1 shows a schematic diagram of the functional aspects of one preferred embodiment of the present invention high frequency, high efficiency quick restart electronic lighting system. Thus, housing unit 100 (a circuit board) is used to mount circuitry and related components. There is a power input connection 3 which is connected to both auto line supply filter 5 and line voltage correction EMI 7. These components cooperate to provide auto-ranging voltage control circuitry to assure that whatever power input 3 provides for power is corrected and/or converted before being fed to PFC microchip controller 9. The PFC microchip controller 9 is a three stage power factor correction controller described in more detail below. PFC microchip controller 9 is connected to feedback current sensor 13 and related components via feedback current sensor 13.

Power factor correction regulator 15 receives bulb status feedback 17 from output to bulb 27 and bulb 29. Additionally, feedback current sensor 13, power factor correction regulator 15 and bulb status feedback 17 are all connected to bulb voltage controller 19. These various components operate together and are controlled by PFC microchip controller 9.

PFC microchip controller 9 is also connected to conditioning filter 21, half bridge 23 and DC output inverter 25 to ultimately control output to bulb 27 to illuminate the aforementioned metal halide high pressure bulb 29. Power is controlled by an on/off switch 31.

Figure 2:
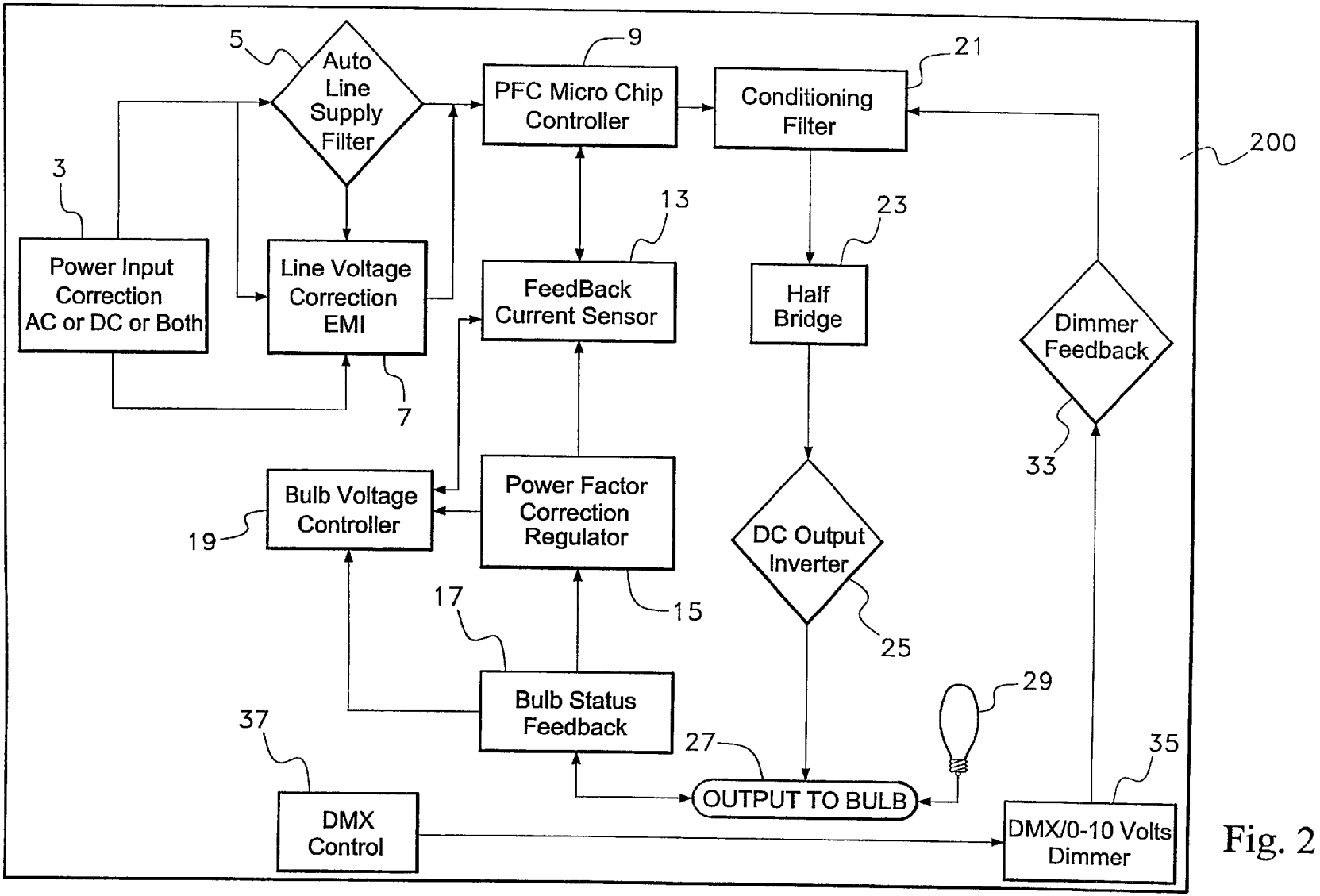
FIG. 2 shows a housing unit with circuitry which is similar to that shown in FIG. 1 except that dimmer features are included.

FIG. 2 shows housing unit 200 with circuitry which is similar to that shown in FIG. 1 except that on/off switch 31 has been replaced. Otherwise, identical parts have been identically numbered. In this embodiment, on/off switch 31 has been replaced with a dimming system which includes dimmer 33, dimmer 35 and dimmer controller 37.

Alternatively, other dimmer arrangements, either manual or automatic (with timers or daylight sensitive or otherwise) may be used. However, as mentioned, dimming is an optional feature and is not used in some preferred embodiments.

Figure 3:
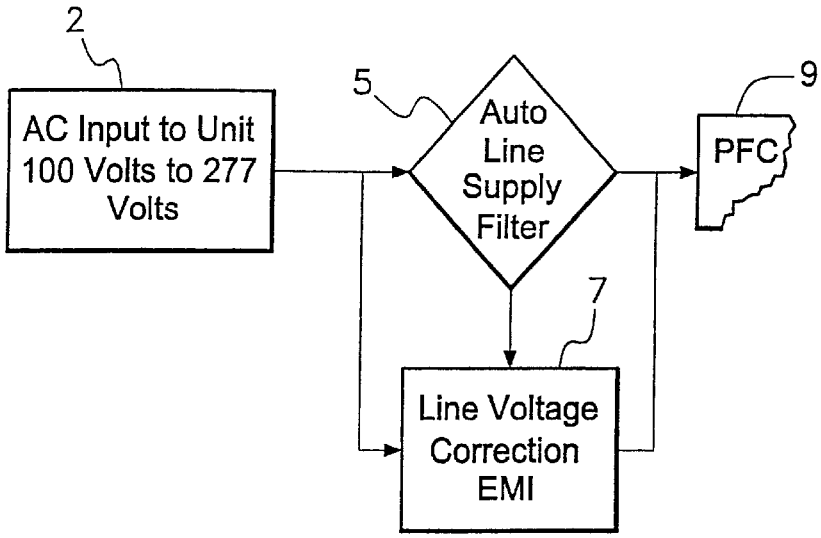
FIGS. 3, 4, and 5 show detailed partial views of the power input side of the systems shown in both FIGS. 1 and 2.
Figure 4:
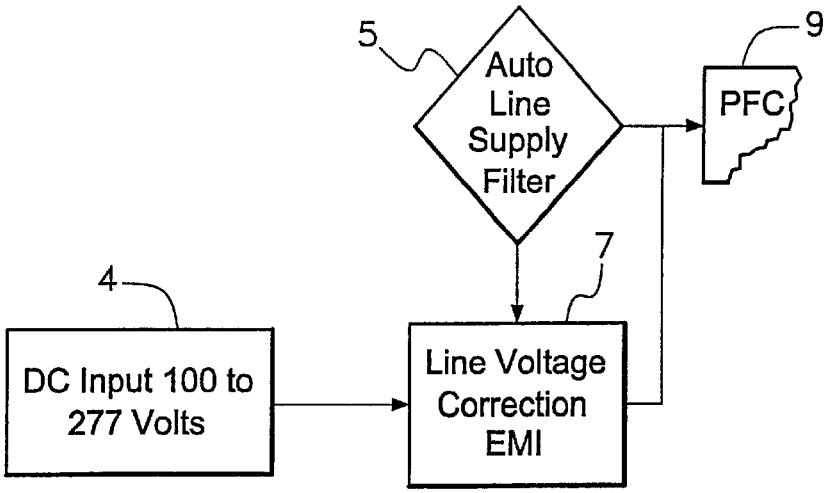
Figure 5:
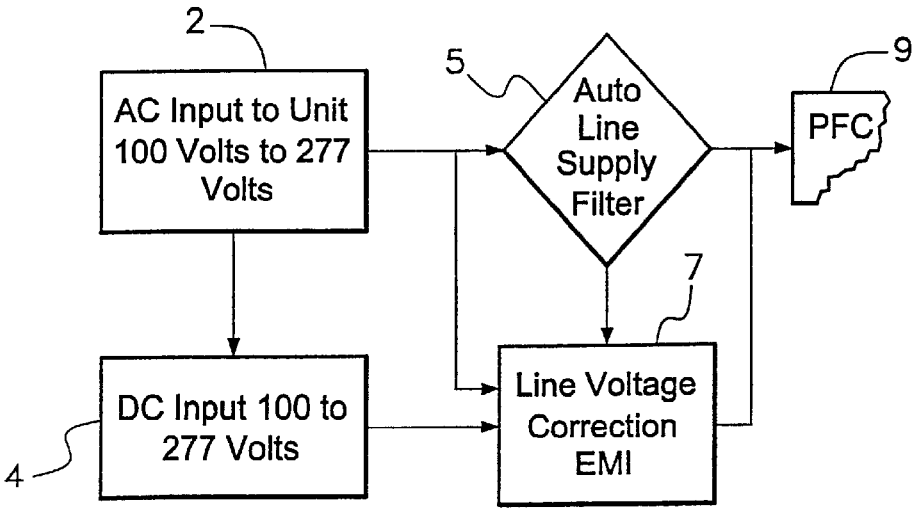

FIGS. 3, 4, and 5 show partial views of the power input side of the systems shown in both FIGS. 1 and 2. Components identical to those shown in FIGS. 1 and 2 are identically numbered. FIG. 3 shows alternating current input 2 which could carry from 100 volts to 277 volts and would function well, as designed. Alternatively, in FIG. 4, direct current input 4 could be employed at similar voltages. Thus, the present invention system could operate from 110 to 220 house current (AC) or otherwise, or could be connected to a battery, fuel cell or other direct current power source. Finally, a combination of both AC input 2 and DC input.4 may be employed as shown in FIG. 5.

Figure 6:
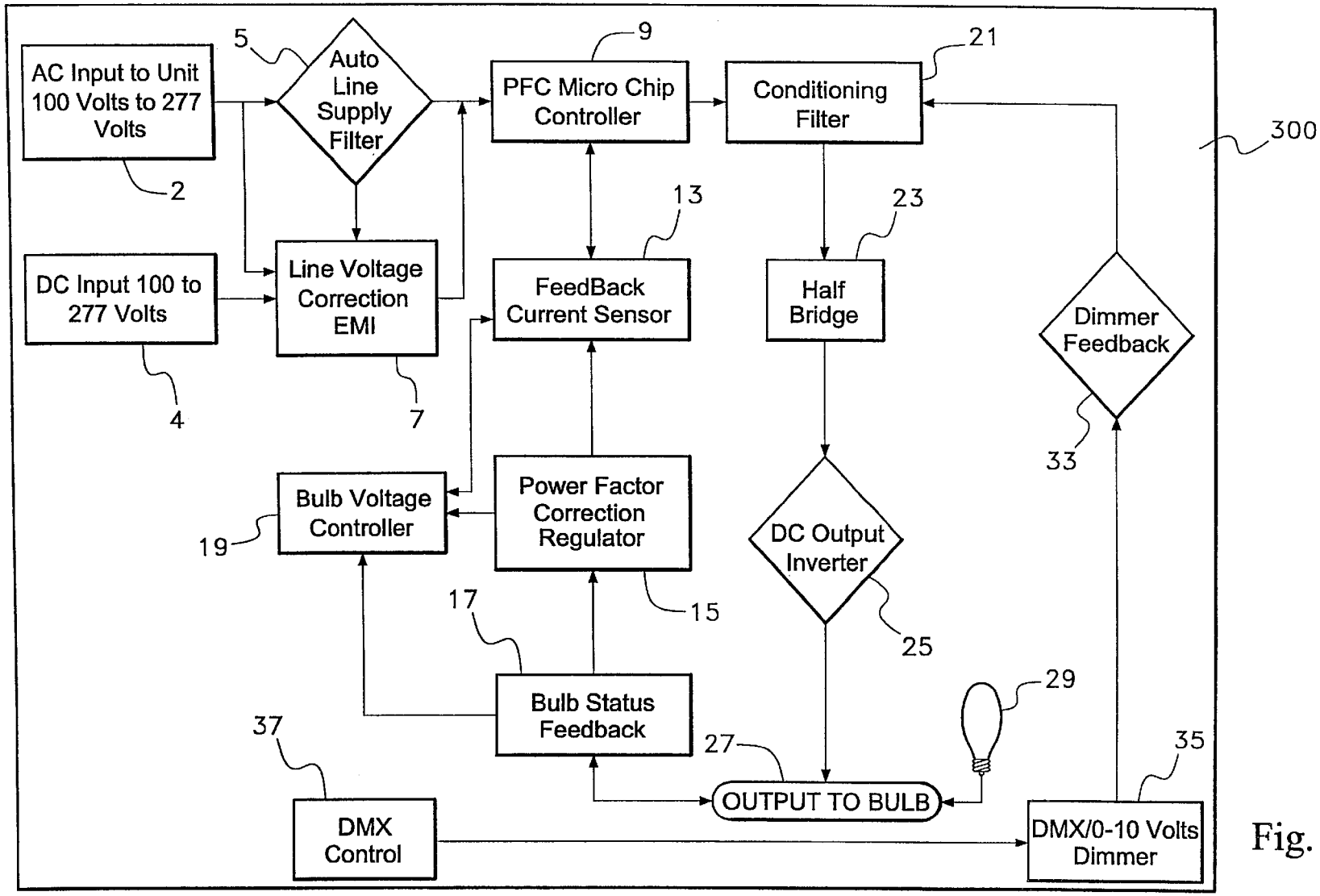
FIG. 6 illustrates a present invention device which represents a complete composite of the FIG. 2 embodiment with the FIG. 5 power input details.

FIG. 6 illustrates housing unit 300 which represents a complete composite of the FIG. 2 embodiment with the FIG. 5 power input details. Identical components are identically numbered.

Figure 7A:
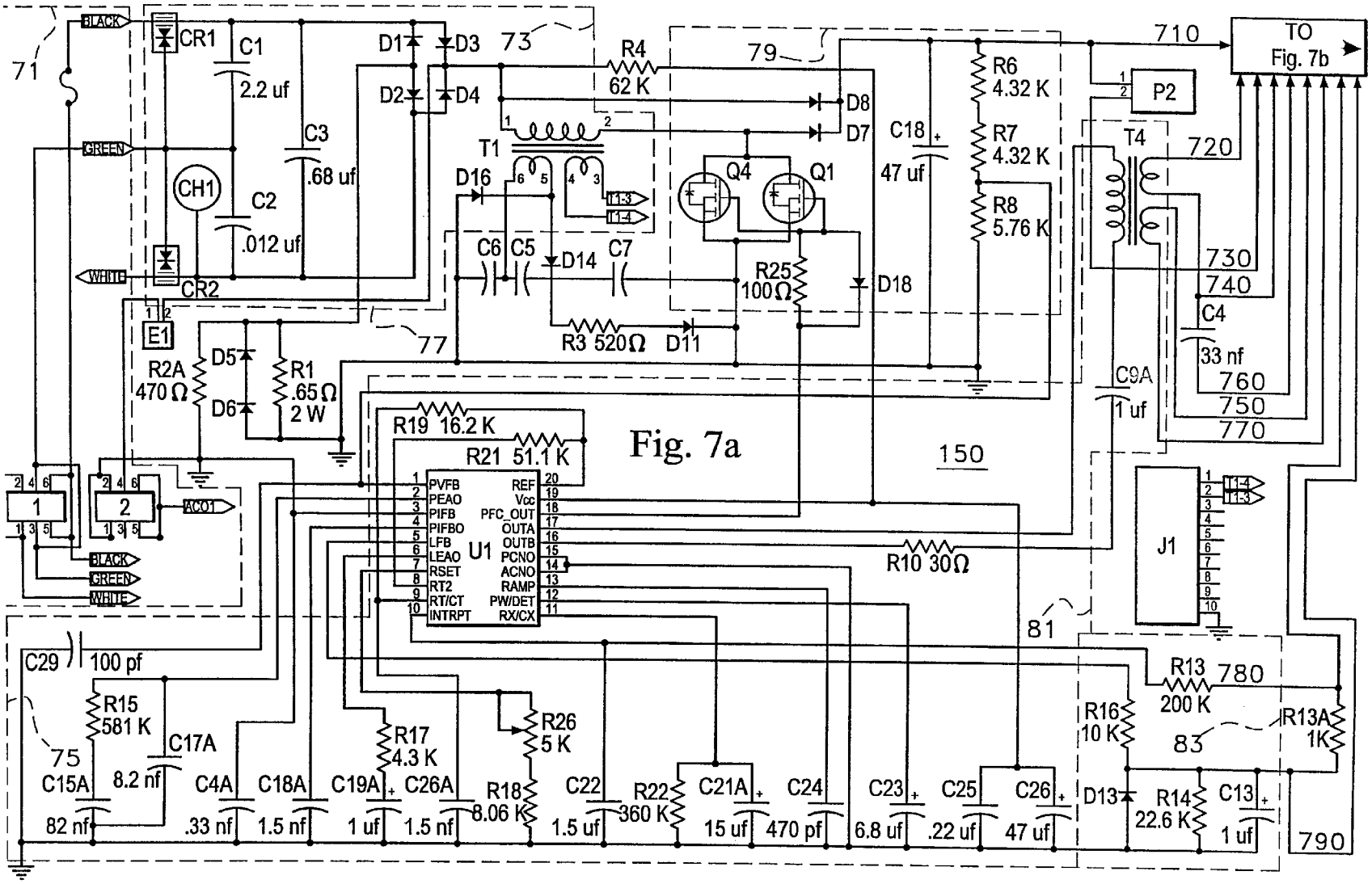
In FIGS. 7*a* and 7*b*, there is shown a complete wiring diagram of one preferred embodiment of the present invention device which corresponds to the FIG. 6 schematic representation.
Figure 7B:
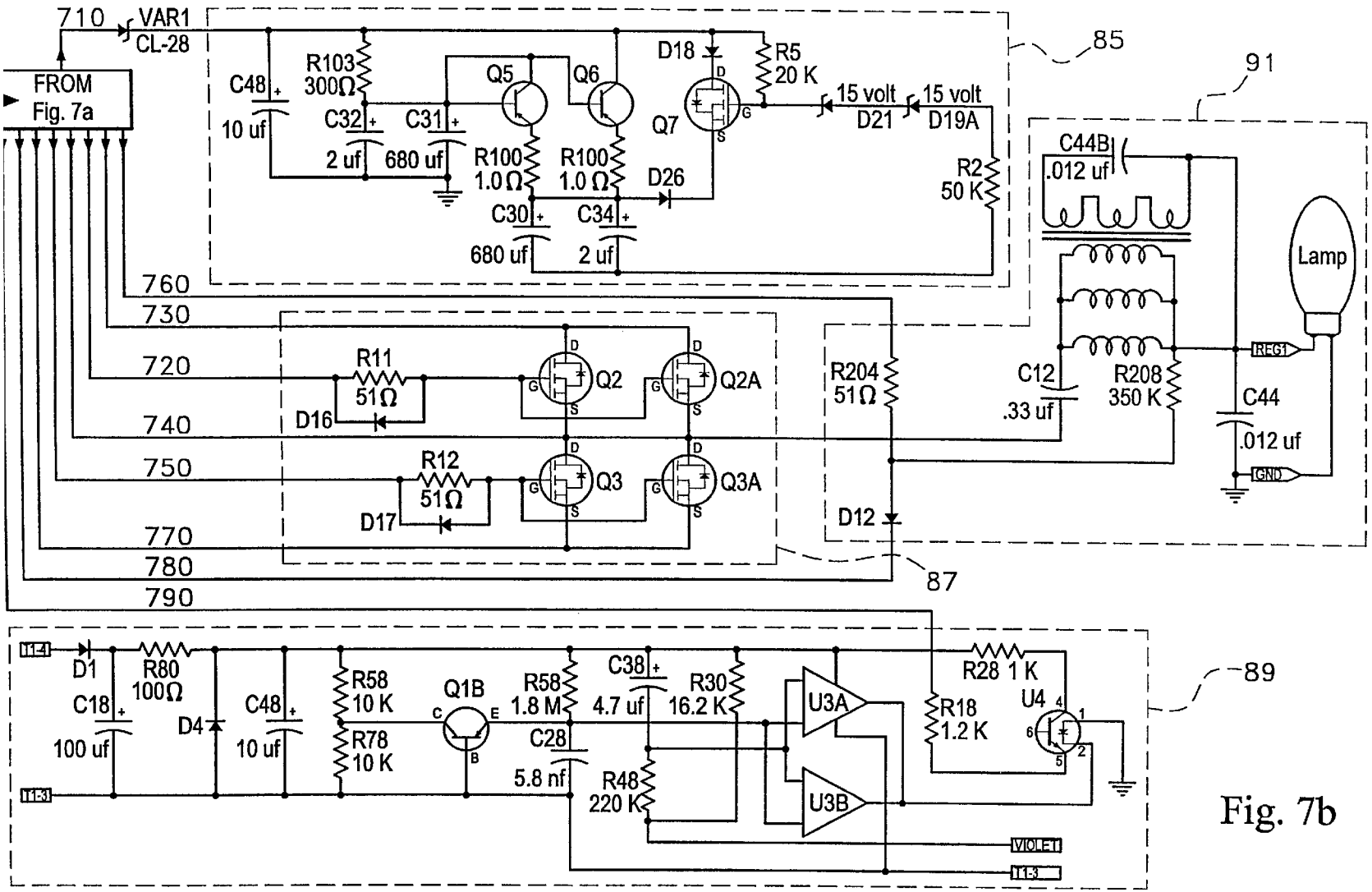

FIGS. 7*a* and 7*b* show a detailed wiring diagram for the present invention systems shown in FIG. 6. In FIGS. 7*a* and 7*b*, there is shown a complete wiring diagram of one preferred embodiment of the present invention which corresponds to the FIG. 6 schematic representation. In FIGS. 7*a* and 7*b*, standard electrical and electronic symbols are utilized and are self-explanatory to the artisan. There are dotted line areas which generally delineate functions which corresponds to FIG. 6. In FIG. 7*a*, block 71 represents power inputs, block 73 represents auto-ranging filter and line voltage correction EMI. Block 75 generally represents the PFC microchip controller and related functions; block 77 represents the feedback current sensor and block 79 represents the power factor correction regulator and related functions. Block 81 generally represents the bulb voltage control function and block 83 generally includes the bulb status feedback section. Connections 710, 720, 730, 740, 750, 760, 770, 780 and 790 shown in FIG. 7*a* are continuing and picked up in FIG. 7*b*, as shown.

Referring now to FIG. 7*b*, block 85 represents the conditioning filter function, block 87 generally represents the DC output inverter and block 89 represents the dimmer system. Finally, block 91 represents the bulb and output to the bulb.

Although the various components shown in FIGS. 7*a* and 7*b* exist, their arrangement is unique and creates surprising results. The PFC microchip controller is, as mentioned, a three stage power factor correction microchip which is shown as item 9 in FIGS. 1 through 6, as a single block.

The following table lists the various specific components and describes their ranges:

| Component and Reference | | Value (units) |
|---|---|---|
| 1N5408 | D2 D3 D4 D5 D8 | 1N540BJ |
| SUF30J | D7 | SUF30J |
| LTG-74 | T3 | 2 mh |
| LTG-9648 | T4 | 5 mh |
| LTG-29 | T2 | 1.8 mh |
| 2PIN-CNT | P1 | |
| 6-PIN-CNT | JP1 | |
| 10PIN-CNT | J1 | {10-Pin} |
| 10PIN-CNT | J2 | {10-Pin} |
| C1206 | D9 | 1N4148 |
| 8252N-CONCT | P1 | |
| C12NEW | C12 | .33 uf @400 v |
| C44A | C44 | .01 uf @1600 V |
| C1206 | D10 | 1N4148 |
| CAP100-SD | C5 C6 | .1 uf |
| CAP100-SD | C17 | 8.2 nf |
| CAP100-SD | C29 | 100 pf |
| CAP100-SMD | C25 | .22 uf |
| CAP100-SMD | C15 | 1 uf |
| CAP100-SMD | C18 | 1.5 nf |
| CAP100-SMD | C22 | 1.5 uf |
| CAP100-SMD | C23 | 6.8 uf |
| CAP100-SMD | C21 | 15 uf |
| CAP100-SMD | C4 | 33 nf |
| CAP100-SMD | C16 | 82 nf |
| CAP100-SMD | C24 | 470 pf |
| CAP200RP | C26 | 47 uf |
| CAP300 | C9 | 1 uf |
| CAP300 | C1 C2 | 2.2 nf |
| CAP300RP | C7 | 100 uf |
| CAP800 | C40 C41 | .01 uf |
| CAP875L | C3 | .47 uf |
| CAP1812N | C28 | 47 uf |
| CHASSISGND | CH2 | |
| CHASSISGND | CH1 | |
| D12 | D12 | 1n3937 |
| D13 | D13 | 5.5 v Zener |
| D16 | D16 | 1n4007 |
| D17 | D17 | 1n4007 |
| D18 | D18 | 1N4148 |
| DIODE1206A | D14 | 75 v Zener |
| FUSE | F1 | Fuse 2 amp |
| HEADER6 | P2 | 6-Pin |
| 1RF450 | Q2 | IRF450 |
| 1RF450 | Q1 | 1RF450 |
| 1RF450 | Q3 | IRG450 |
| ML4835 | U1 | ML4835N |
| PCAP450L875C | C10 | 47 uf |
| PHILIPS_SM | C11 | 330 PF |
| POT_BOURNS | R26 | 5k ohms |
| PQ-TRANS | T1 | Transformer PF |
| R6 | R6 | 430k ohms |
| R7 | R7 | 430K ohms |
| R8 | R8 | 5.6K ohms |
| R11 | R11 | 51 Ohm |

-continued

| Component and Reference | | Value (units) |
|---|---|---|
| R12 | R12 | 51 Ohm |
| R13 | R13A | 1k ohm |
| R13A | R13 | 200k ohm |
| R14 | R14 | 22k ohm |
| R16 | R16 | 10k ohm |
| R25 | R25 | 51 Ohm |
| R203 | R204 | 51 Ohm |
| R220 | R200 | 420K ohm |
| RES1/8SMT | R18 | 8.2k ohm |
| RES1/8SMT | R21 | 51.1k ohm |
| RES1/8SMT | R22 | 360k ohm |
| RES600 | R2 | 330 ohm |
| RES800 | R1 | 0.22 ohm 5 watt |
| RES0SMT | R9 | 4.3k ohm |
| RES-SMT | R17 | 5.6k ohm |
| RES-SMT | R19 | 16.0k ohm |
| RES-SMT | R24 | 20k ohm |
| RES-SMT | R10 | 30 ohm |
| RES-SMT | R15 | 681k ohm |
| RES-SMT | R3 | 820 OHM |
| RESISTOR400_1/4 | R4 | 62K ohm |
| SMTDIODE2 | D11 | 15 v Zener |

In the above table, the references include a letter, wherein each represents a component in accordance with the following legend:

P=connector

C=capacitor

D=diode

J=connector

Q=mosfet

U=choke

R=resistor

CH=chasis ground

F=fuse.

Figure 8:
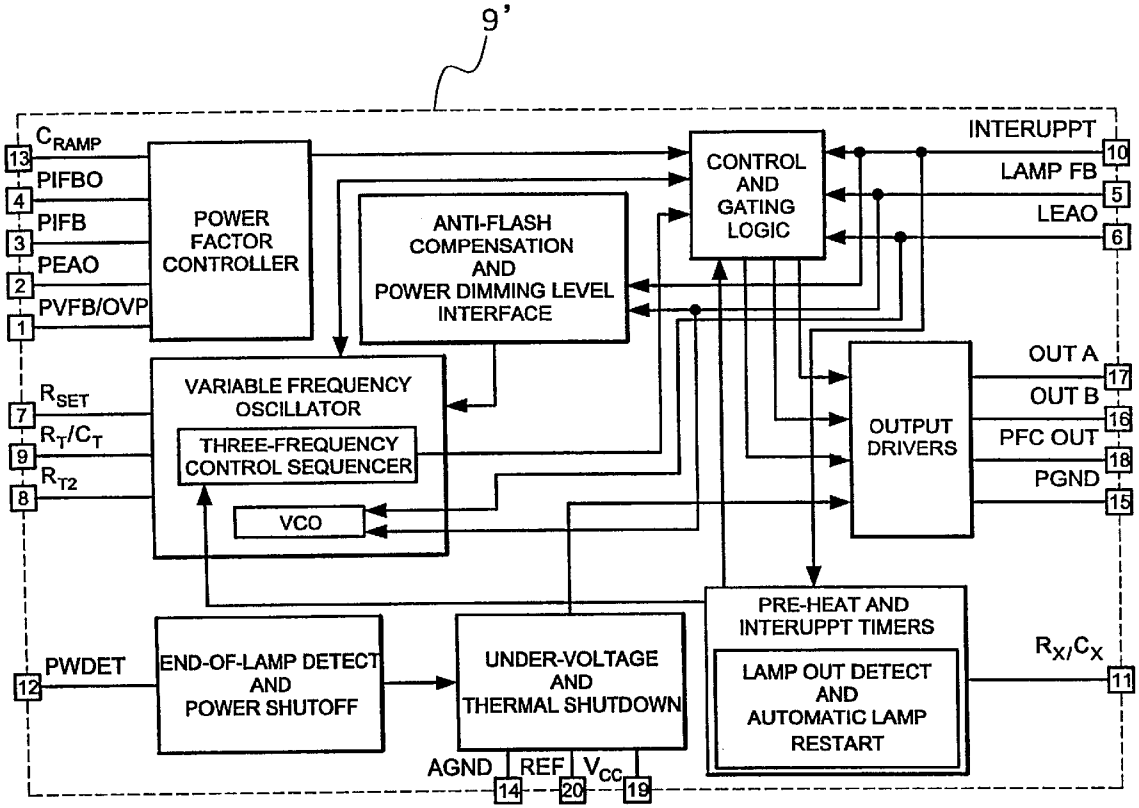
In FIG. 8, a PFC microchip controller is detailed in its functionality and in FIG. 9 it is shown by pin (connection), and in FIG. 10 it is shown by component details in block diagram form.

In FIG. 8, this microchip is detailed in its functionality and shown as chip 9'. It is also shown in FIG. 9 by pin (connection) arrangements as chip 9", and in FIG. 10 it is shown by component details in block diagram form, as chip 9'".

Figure 9:
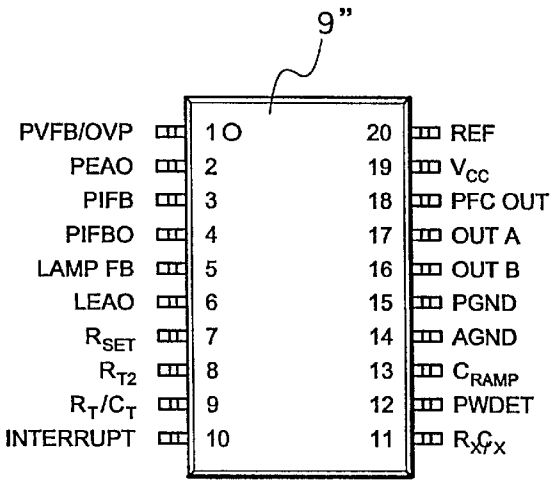
Figure 10:
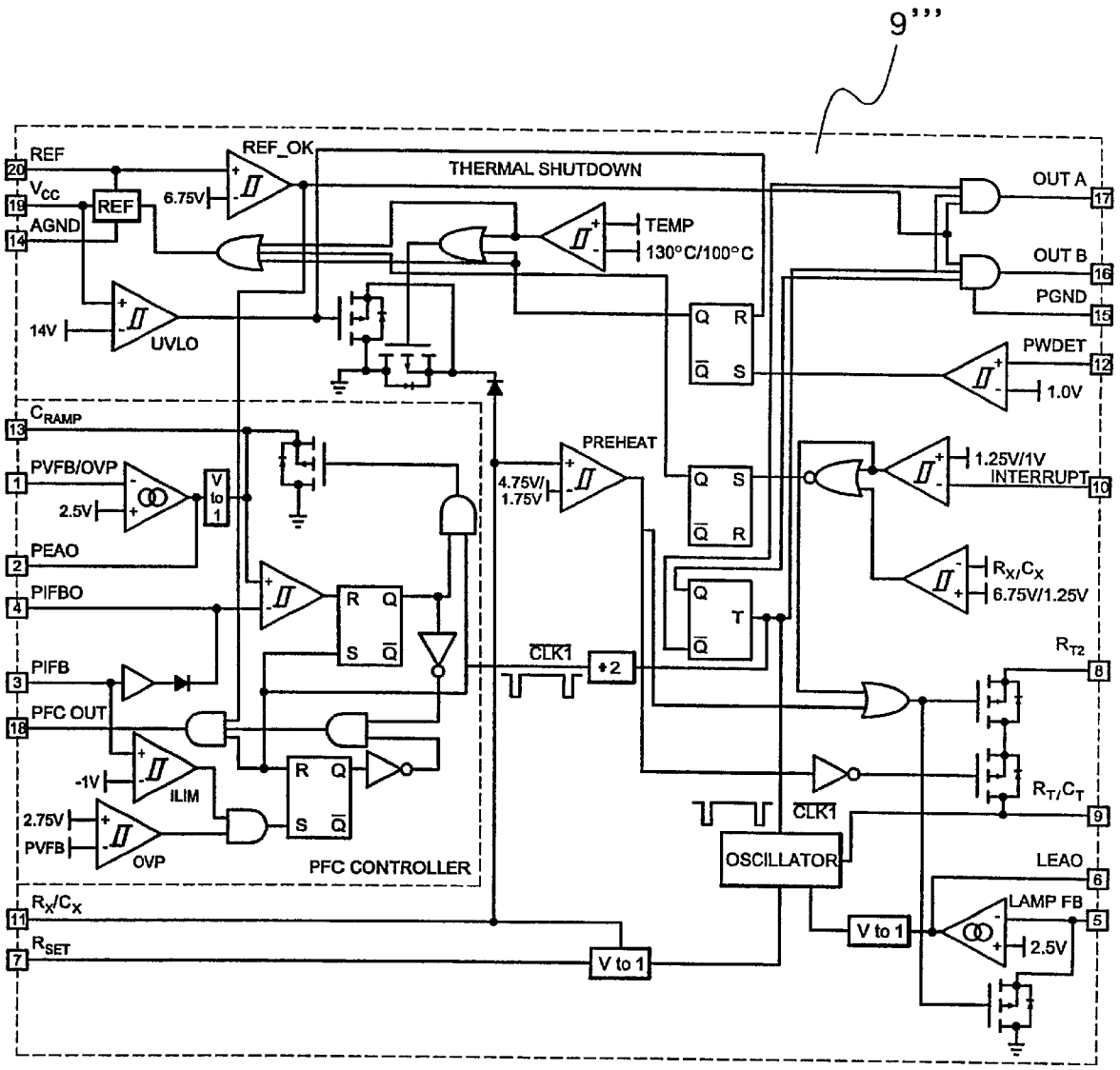

The following is a description of the pin numbers, names and functions for the 20 pins shown in FIGS. 8, 9 and 10:

| PIN | NAME | FUNCTION |
|---|---|---|
| 1. | PVFB/OVP | Inverting input to the PFC error amplifier and OVP comparator input. |
| 2. | PEAO | PFC error amplifier output and compensation node. |
| 3. | PIFB | Senses the inductor current and peak current sense point of the PFC cycle by cycle current limit. |
| 4. | PIFBO | Output of the current sense amplifier. Placing a capacitor to ground will average the inductor current. |
| 5. | LAMP FB | Inverting input of the lamp error amplifier, used to sense and regulate lamp arc current. Also the input node for dimmable control. |
| 6. | LEAO | Output of the lamp current error transconductance amplifier used for lamp current loop compensation. |
| 7. | $R_{set}$ | External resistor which SETS oscillator $F_{MAX}$, and $R_X/C_X$ charging current. |
| 8. | $R_{T2}$ | Oscillator timing component to set start frequency. |
| 9. | $R_T/C_T$ | Oscillator timing component. |

-continued

| PIN | NAME | FUNCTION |
|---|---|---|
| 10. | INTERRUPT | Input used for lamp-out detection and restart. A voltage less than 1 V will reset the IC and cause a restart after a programmable interval. |
| 11. | $R_X/C_X$ | Sets the timing for preheat and interrupt. |
| 12. | PWDET | Lamp output power detection. |
| 13. | $C_{RAMP}$ | Integrated voltage of the error amplifier out. |
| 14. | AGND | Analog ground. |
| 15. | PGND | Power ground. |
| 16. | OUT B | Ballast MOSFET driver output. |
| 17. | OUT A | Ballast MOSFET driver output. |
| 18. | PFC OUT | Power factor MOSFET driver output. |
| 19. | VCC | Positive supply voltage. |
| 20. | REF | Buffered output for the 7.5 V reference. |

The three stage microchip utilized in the present invention has all of the features set forth in FIGS. 8,9 and 10, and, while the microchip may be obtained "off the shelf" commercially, its use in the particular arrangements described herein and illustrated by FIGS. 1 through 7*a* and 7*b* have neither been taught nor rendered obvious by the present invention. In fact, Micro Linear Corporation of San Jose, Calif. manufactures this chip as a compact fluorescent electronic dimming controller as product ML 4835. This microchip is, as mentioned, a three stage microchip which uses a first frequency for pre-start up heating, a second frequency for actual bulb start up and a third frequency for bulb illumination operation. Such chips are available from other manufacturers in addition to Micro Linear Corporation.

Figure 11:
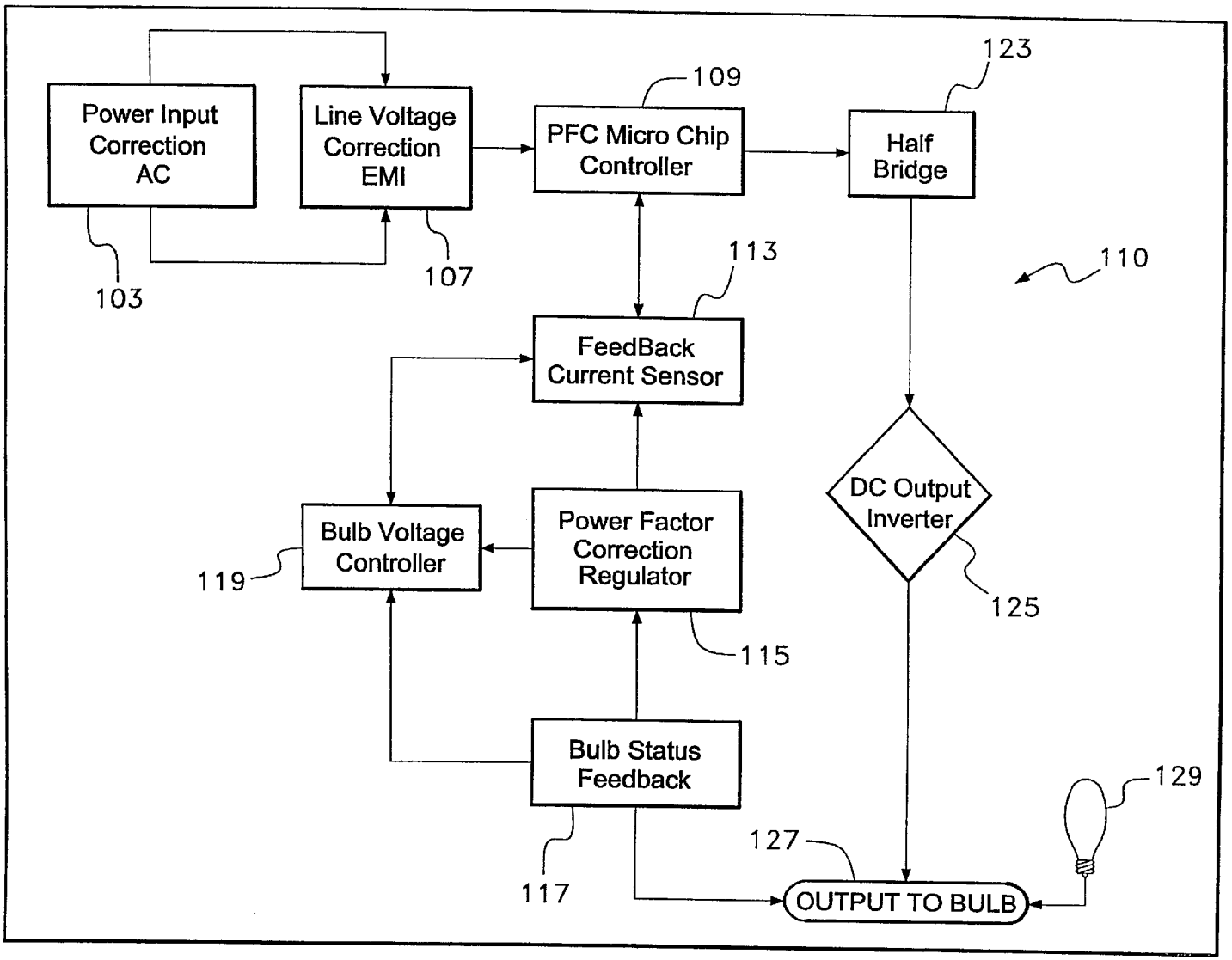
FIG. 11 illustrates another schematic diagram of a preferred embodiment alternating current power source-based high frequency, high efficiency quick restart electronic lighting system of the present invention.

FIG. 11 shows a schematic diagram of another preferred embodiment system, illustrating the functional aspects of a present invention high frequency, high efficiency quick restart electronic lighting system. Thus, housing unit 110 (a circuit board) is used to mount circuitry and related components. There is an AC power input connection 103 which is connected to line voltage correction EMI 107. These components cooperate to provide voltage control circuitry to assure that whatever power input 103 provides for power is corrected before being fed to PFC microchip controller 109. The PFC microchip controller 109 is a three stage power factor correction controller described in more detail above and below. PFC microchip controller 109 is connected to feedback current sensor 113 and related components via feedback current sensor 113.

Power factor correction regulator 115 receives bulb status feedback 117 from output to bulb 127 and bulb 129. Additionally, feedback current sensor 113, power factor correction regulator 115 and bulb status feedback 117 are all connected to bulb voltage controller 119. These various components operate together and are controlled by PFC microchip controller 109.

PFC microchip controller 109 is also connected to half bridge 123 and DC output inverter 125 to ultimately control output to bulb 127 to illuminate the aforementioned iodine and/or bromine-based metal halide high pressure bulb 129. Power may be controlled by an on/off switch, a computer or other mechanism (not shown).

Figure 12:
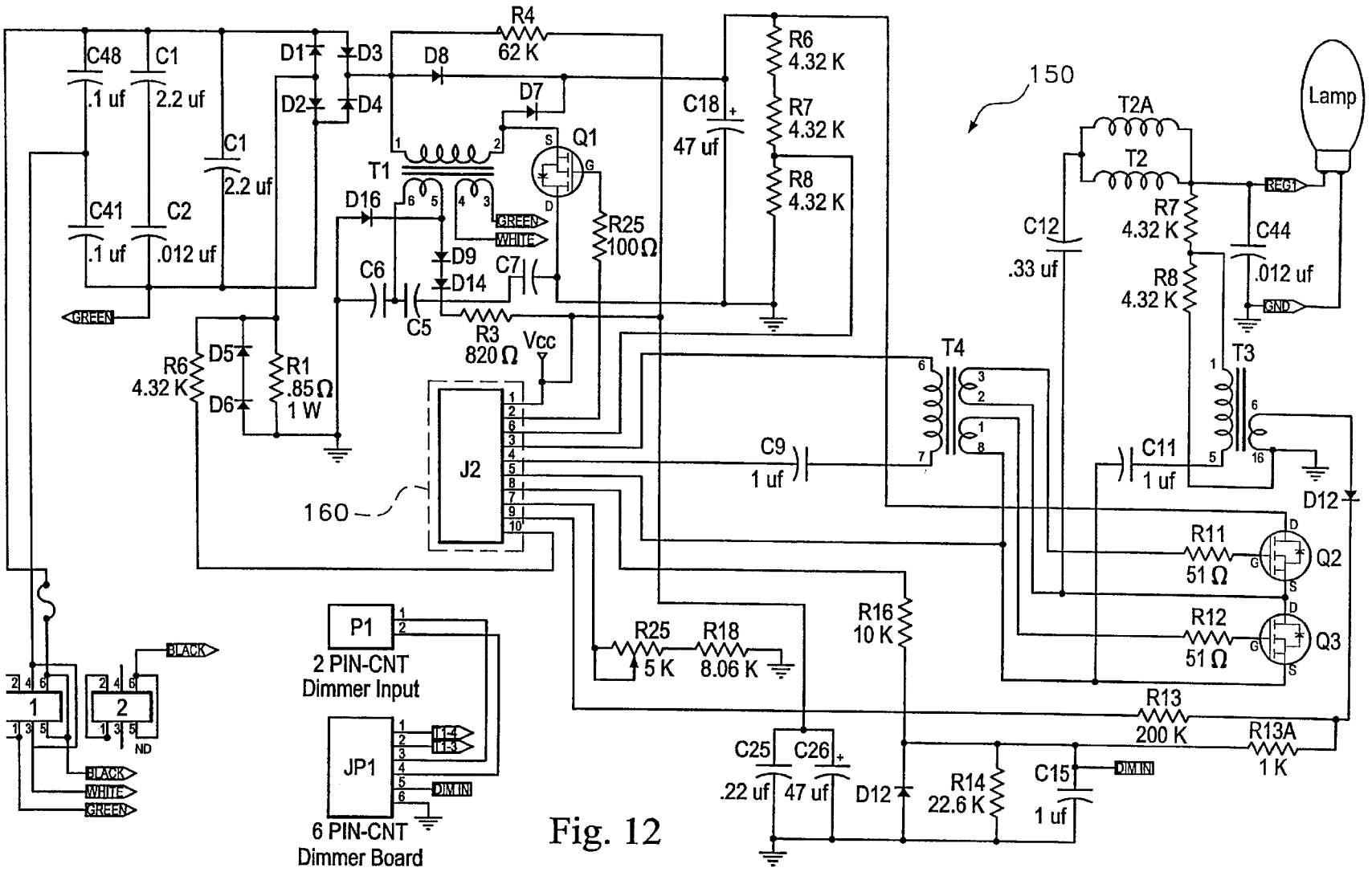
FIG. 12 shows a wiring diagram corresponding to the schematic diagram system shown in FIG. 11; and, FIG. 13 illustrates the details of the PFC microchip controller used in conjunction with the system shown in FIGS. 11 and 12.
Figure 13:
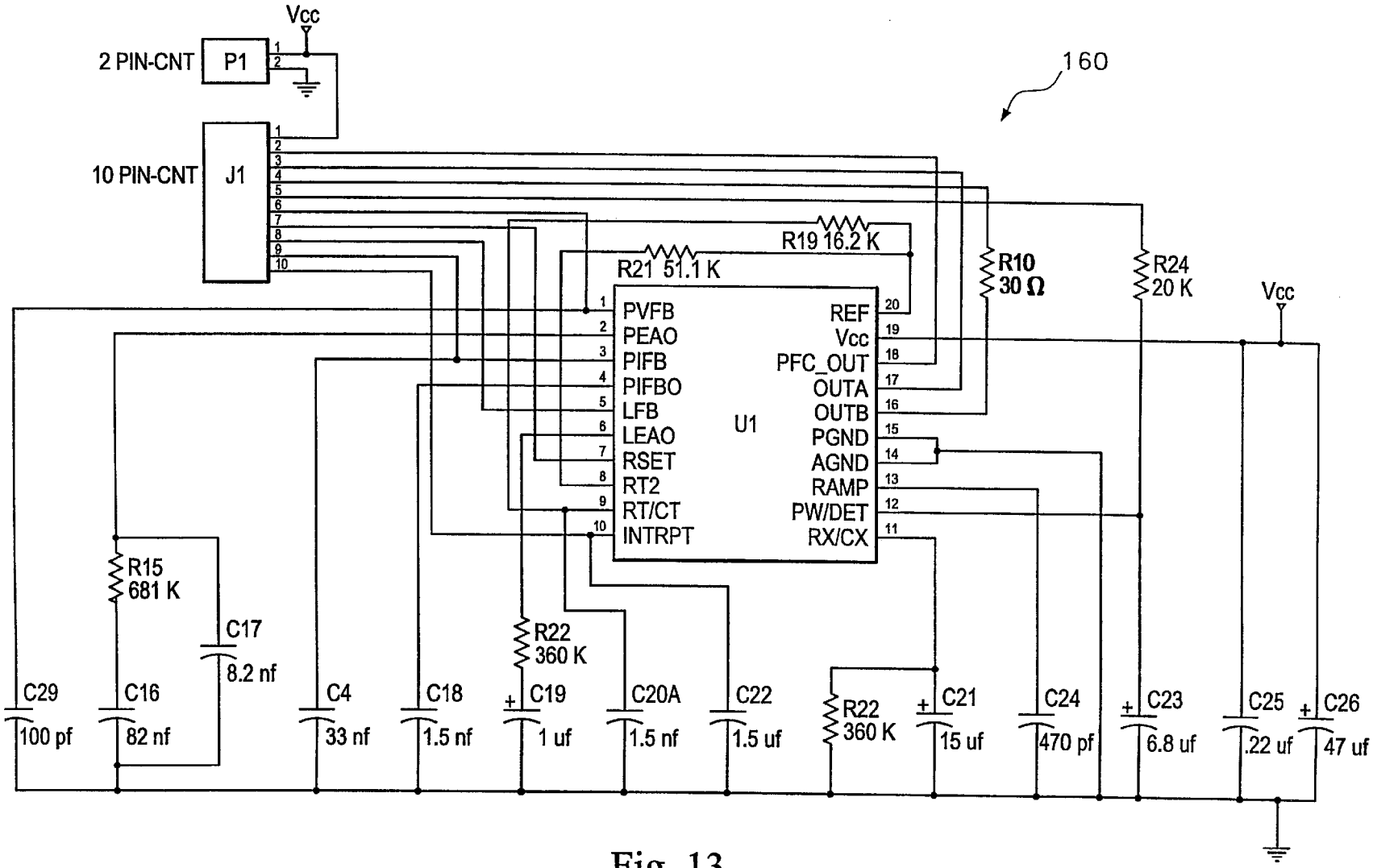

FIG. 12 shows a detailed wiring dagram of the system shown schematically in FIG. 11 above. A comparison of FIG. 6 and other figures above with FIG. 11 will readily reveal common components. All of the components in FIG. 11 are used in the FIG. 6 and the earlier figure schematics. Likewise, all of the detailed wiring diagram components shown generally as system 150 in FIG. 12 are shown in FIGS. 7*a* and 7*b* below and need not be discused in detail in duplicate as to FIG. 12. In other words, an artisan will now recognize the components of FIG. 12 by review of the foregoing Figures. Additionally, in FIG. 12, the block 160 generally represents the PFC microchip controller and related functions. This PFC microchip controller 160 is shown in detail in FIG. 13 . Again, values and components correspond to the foregoing teachings.

By the present invention system, conventional metal halide bulbs are started efficiently and economically and, very significantly, the present invention system has been utilized to illuminate these metal halide lamps, and to rapidly restart them, in seconds. Thus, the present invention system performs unexpectedly and in a manner heretofore not seen, by quickly restarting these high pressure metal halide lamps. With the present invention system such lamps can be restarted in 30 seconds and typically in less than three seconds, without any difficulty or technical problems, and will have achieved more than 75% of its maximum lighting output within that start up time. In most preferred embodiments of the present invention, this can be achieved in less than one second.

In the present invention, the metal halide discharge lamp has a color temperature between 4000 K and 7000 K, a color rendition index $R_a$>80 and at the same time an improved devitrifying behavior relative to conventional metal halide lamps. Also, an increase in luminous flux and particularly brightness are achieved by increasing the Color Rendering Index (CRI).

As mentioned, the filling contains the metals that combine and dissociate with the halogens, at least one inert gas, mercury (Hg) and at least one halogen. Preferably iodine (I) and/or bromine (Br) are used as halogens for forming the halides. The inert gas, e.g., argon (Ar) with a typical filling pressure of the order of magnitude of up to approximately 80 kPa serves for igniting the discharge. The desired arc-drop voltage is typically adjusted by the mercury Typical quantities for Hg lie in the range between approximately 10 mg and 30 mg per $cm^3$ of vessel volume for arc-drop voltages between 50 V and 100 V.

In some preferred embodiments, the molar filling quantities of the metals are typically in amounts up to 15 $\mu$moles, up to 30 $\mu$moles or up to 0.6 $\mu$mole per $cm^3$ of vessel volume, respectively. The molar filling quantity of Hf and/or Zr lies in the region between 0.005 $\mu$moles and 35 $\mu$mole, preferably in the region between 0.05 $\mu$mole and 5 $\mu$moles per $cm^3$ of volume of the discharge vessel.

Other quanitiy ranges for the content of the bulb may be employed rather than those set forth above, without exceeding the scope of the present invention. Thus, contents for commercially available metal halide lamps are included within the scope of the present invention.

Obviously, numerous modifications and variations of the present invention are possible in light of the above teachings. It is therefore understood that within the scope of the appended claims, the invention may be practiced otherwise than as specifically described herein.

What is claimed is:

1. A high frequency, high efficiency electronic system for lighting, which comprises:

(a) a housing unit to mount electronic circuitry and related components;

(b) electronic circuitry and components mounted on said housing unit, which includes:

(i) means for connecting and applying a power input to said circuitry;

(ii) switch means for switching a lamp on and off, which switch means is connected to control power to said circuitry;

(iii) auto-ranging voltage control circuitry and components, including an auto line supply filter and a line voltage correction EMI to provide an auto-ranging voltage intake/output capability;

(iv) a three stage power factor correction microchip controller, said microchip controller being a Bi-CMOS microchip;

(v) a feedback current sensor;

(vi) a power factor correction regulator;

(vii) lamp status feedback means;

(viii) a lamp voltage controller;

(ix) a conditioning filter;

(x) a half-bridge;

(xi) a DC output inverter; and, (xii) output means and connection for a lamp; and, (c) a metal-halide discharge lamp which is includes a discharge vessel having a cavity, two electrodes operatively positioned within said cavity, and an ionizable filling within said cavity, said filling comprising at least one inert gas, mercury, at least one halogen and at least one metal capable of chemically combining and dissociating with the halogen.

2. The system of claim 1 wherein the halogen is selected from the group consisting of iodine, bromine and combinations thereof.

3. The system of claim 2 wherein said halogen is iodine.

4. The system of claim 1 wherein said filling contains a metals selected form the group consisting of scandium, sodium and combinations thereof.

5. The system of claim 1 wherein said metal is selected from the group consisting of dysprosium, holmium, thulmium and combinations thereof.

6. The system of claim 1 wherein said electrodes of said discharge vessel define therebetween a given arc length and said lamp operates with a specific arc power of about 180 to 240 W per mm of said given arc length.

7. The system of claim 4 wherein said halogen includes at least iodine.

8. The system of claim 5 wherein said halogen is iodine.

9. The system of claim 1 wherein said means for connecting and applying a power input to said circuitry has connection and adaption for receiving either AC current or DC current.

10. The system of claim 1 wherein said three stage power factor correction microchip controller includes power detection means for end-of-lamp-life detection, a current sensing PFC section based on continuous, peak or average current sensing, and a low start up current of less than about 1 amp.

11. The system of claim 10 wherein said three stage power factor correction microchip contains a three frequency control sequencer.

12. The system of claim 11 wherein said three stage power factor correction microchip includes corrections for each of the following functions:

(1) inverting input to a PFC error amplifier and OVP comparator input;

(2) PFC error amplifier output and compensation mode;

(3) sense inductor current and peak current sense point of PFC cycle-by-cycle current limit;

(4) output of current sense amplified;

(5) inverting input of lamp error amplifier to sense and regulated lamp arc current;

(6) output lamp current error transconductance amplifier to sense and regulate lamp arc current;

(7) external resistor to set oscillator to $F_{max}$ and $R_x/C_x$, charging current;

(8) oscillator timing component to set start frequency;

(9) oscillator timing components;

(10) input for lamp-out detection and restart;

(11) resistance/capacitance to set timing for preheat and interrupt;

(12) timing set for preheat and for interrupt;

(13) integrated voltage for error amplifier output;

(14) analog ground;

(15) power ground;

(16) ballast MOSFET first drive/output;

(17) ballast MOSFET second drive/output;

(18) power factor MOSFET driver output;

(19) positive supply voltage; and,

(20) buffered output for specific voltage reference.

13. The system of claim 1 wherein said power factor correction regulator is a power factor correction regulator selected from the group consisting of those having one MOSFET switching circuit, and those having two MOSFET switching circuits.

14. The system of claim 1 wherein said DC output inverter is a DC output inverter selected from the group consisting of those having two MOSFET switching circuits, and those having four MOSFET switching circuits.

15. The system of claim 1 wherein said electronic circuitry and components switch means further includes dimmer circuitry and components.

16. The system of claim 1 wherein said power input to said circuitry is a DC power input.

17. The system of claim 16 wherein said three stage power factor correction microchip controller includes power detection means for end-of-lamp-life detection, a current sensing PFC section based on continuous, peak or average current sensing, and a low start up current of less than about 1 amp.

18. The system of claim 17 wherein said metal halide lamp is a 400 watt lamp at 2.2 amps.

* * * * *